United States Patent [19]

Glass, deceased et al.

[11] 4,020,765

[45] May 3, 1977

[54] LIGHT ACTIVATED FUZE

[75] Inventors: Coy M. Glass, deceased, late of Towson, Md.; James G. Dante, Churchville, Md.

[73] Assignee: The United States of America as represented by the Secretary of the Army, Washington, D.C.

[22] Filed: Nov. 7, 1975

[21] Appl. No.: 629,818

[52] U.S. Cl. ..... 102/70.2 R; 102/56 SC

[51] Int. Cl.[2] ..... F42C 11/00; F42C 1/00; F42C 13/02; F42C 11/02

[58] Field of Search ..... 102/70.2 R, 70.2 GA, 102/56 SC

[56] References Cited

UNITED STATES PATENTS

| | | | |
|---|---|---|---|
| 2,457,393 | 12/1948 | Muffly | 102/70.2 P |
| 3,373,687 | 3/1968 | Simmons | 102/56 SC |
| 3,485,461 | 12/1969 | Katsanis | 102/70.2 R |
| 3,613,585 | 10/1971 | Dubroff | 102/56 SC |
| 3,837,282 | 9/1974 | Marrow | 102/70.2 R |

*Primary Examiner*—Samuel W. Engle
*Assistant Examiner*—Thomas H. Webb
*Attorney, Agent, or Firm*—Nathan Edelberg; Robert P. Gibson; Saul Elbaum

[57] ABSTRACT

In a warhead assembly having an explosive and a detonator for activating said explosive, a fuze comprising a triboluminescent material coated on the interior portion of said assembly, a photo-sensitive detector for detecting the light caused by said triboluminescent material upon impact of said warhead assembly, and means responsive to said photo-sensitive detector and communicating with said detonator so as to cause the detonator to activate and detonate the explosive.

14 Claims, 2 Drawing Figures

LIGHT ACTIVATED FUZE

RIGHTS OF THE GOVERNMENT

The invention described herein may be manufactured, used and licensed by or for the U.S. Government for governmental purposes without payment to us of any royalty thereon.

BACKGROUND OF THE INVENTION

This invention relates to ordinance devices. More specifically, this invention relates to light activated fuzes for use in weapons such as bombs, artillery projectiles, and the like.

The prior art contains numerous examples of systems designed to achieve either delayed detonation or point detonation. Point detonation fuzes used in warheads require some form of communication between the point of impact and the detonator which in most cases resides in the rear of the warhead. Generally, the front of the warhead is given an ogive having some geometrical form such as conical, spike, etc. The ogive impacts the target and a signal is produced which is transmitted back to the detonator so as to activate the explosive charge. An exception to this type of system is the "spitter" point detonator fuze which is a small shaped charge located in the front of the ogive. On impact, the spitter shaped charge is activated and a stream of particles is projected from the front of the ogive back towards the shaped charge warhead, into a spit-back tube in the apex of the shaped charge and detonating the explosive at the top of the tube. These prior art devices have been found to contain the following disadvantages:

1. A single piezo-element in the nose of the ogive offers only a limited area of impact on the ogive where the fuze causes the warhead to function.

2. To provide full-frontal-fuze functioning, additional piezo-electric elements must be placed around the ogive in proximity to the surface where it joins the base of the warhead.

3. Double ogives are frequently used to act as a closure or crusher switch to complete when they impact the target.

4. A wire is run from the piezo-electric element and/or the crusher switch, back through the wall of the shaped charge to the safety and arming device and detonator. In some cases, the wire is replaced by a metal strip running down the side of the warhead.

5. When spit-back fuzes are used, the material in the fuze sits in the path of the jet, and the activation of the spitter causes some damage to the warhead.

These prior art devices may require materials to be placed in front of the jet in its formative stages or the formation of holes through the shaped charge liner wall to accommodate the wires. Additionally, these prior art devices may have the disadvantage of lacking full ogive-impact-functioning capabilities, closure switch malfunctioning or asymmetries produced in the detonation wave in the explosion by the conducting bar running up the side of the charge, particularly for lightly confined warheads containing small amounts of explosives.

U.S. Pat. No. 3,837,282 issued Sept. 24, 1974 to Warren P. Morrow discloses the use of chemical light as a timing device for mine, bomb and tube-fired munitions. There is utilized chemically reactive components which upon mixture create a detectable chemiluminescent light.

Accordingly, it is a primary object of this invention to provide a fuze for use in warheads which avoids all of the above mentioned disadvantages. An additional object of the present invention is to provide a means for activating a detonator which causes the explosive in a warhead to detonate, and functions when the warhead impacts a target at which it has been fired, without the use of wires, closure switches, or other mechanical devices running from the ogive back to the detonator.

A still further object of the present invention is to provide communication between a warhead's front portion which strikes the target, and the safety and arming section of the warhead which contains the detonator, through the generation of light on impact of the warhead.

Still another object of the present invention is to provide full sensitivity for functioning of the warhead when any portion of the frontal section impacts the target.

An additional object of the present invention is to provide a light activated fuze for use in warheads which is insensitive when the warhead encounters brush, grass, rain or some other form of low-level impact.

SUMMARY OF THE INVENTION

The present invention relates to a fuze for use in warheads that utilizes light created by impact of a warhead ogive that is coated on its interior portion with a triboluminescent material which activates a circuit by a light impinging on a photosensitive detector which causes the detonator of the fuze to activate so as to detonate the warhead explosive.

In accordance with the present invention, the fuze utilizes a light created by the impact of a warhead ogive which is coated with a triboluminescent material which activates a circuit by the light impinging on a photosensitive detector which permits current to pass through the detonator so as to produce detonation of the explosive.

The present invention is based on the concept that the most efficient and simplest method of communication between the ogive, which impacts the target, and the apex of the shaped charge warhead lining is through the use of light. From the apex of the shaped charge liner, a thin tube is preferably used to carry information back to the detonator at the rear of the warhead.

BRIEF DESCRIPTION OF THE DRAWINGS

The precise nature and operation of the present invention will be better understood with reference to the drawings in which.

DESCRIPTION OF THE PREFERRED EMBODIMENTS

Figure 1:
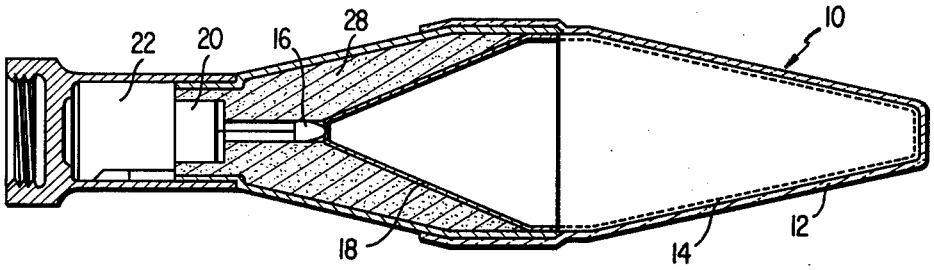
FIG. 1 is a cross-sectional view in schematic form of a warhead assembly with the light activated fuze of the present invention.

As seen in FIG. 1, there is shown a warhead assembly 10 having an ogive 12 having coated on the inside of the ogive triboluminescent material 14. The triboluminescent material 14 is one which emits light when impacted. The coating of triboluminescent material 14 is on the entire inside surface of the ogive, thereby producing light whenever any part of the ogive strikes the target. Triboluminescent material which may be utilized in the present invention include:

| | |
|---|---|
| Zinc Fluoride: Manganese Activated | ($ZnF_2$:Mn) |
| Zinc Sulfide: Silver Activated | (ZnS:Ag) |
| Zinc Sulfide: Manganese Activated | (ZnS:Mn) |
| Calcium Pyrophosphate: Dysprosium | ($CaP_2O_7$:$D_4$) |
| Zinc Cadmium Sulfide | (ZnCdS) |

However, it is understood that other triboluminescent-like materials that produce light on impact may be utilized, such as zirconium-tin-alloy.

The light intensity given off by the triboluminescent coating is a function of the strength of the impact stress produced when the ogive 12 encounters a target or encounters low intensity materials such as brush, rain, etc. When the ogive 12 impacts a solid object, a strong shock is produced in the triboluminescent material 14 and light of a high intensity is emitted. When the strength of the shock is low, as when the warhead assembly is passing through grass or rain, the light intensity is low.

The light which is generated upon impact is received by a photo-sensitive detector 16, which may be a photo-silicon-controlled-rectifier (photo-SCR) 16 that is preferably located at the apex of a conical shaped charge liner 18.

In operation, upon launching of the warhead 10, a power supply 22 is activated and upon impact of the ogive 12 the triboluminescent material 14 creates a light which will be detected by the photo-sensitive detector. If desired, the electrical signal from detector 16 may then be transitted to and amplified by amplifier 20, and this amplified signal is then utilized to activate detonator 24 which in turn will activate the explosive 28 in a known and conventional manner.

Figure 2:
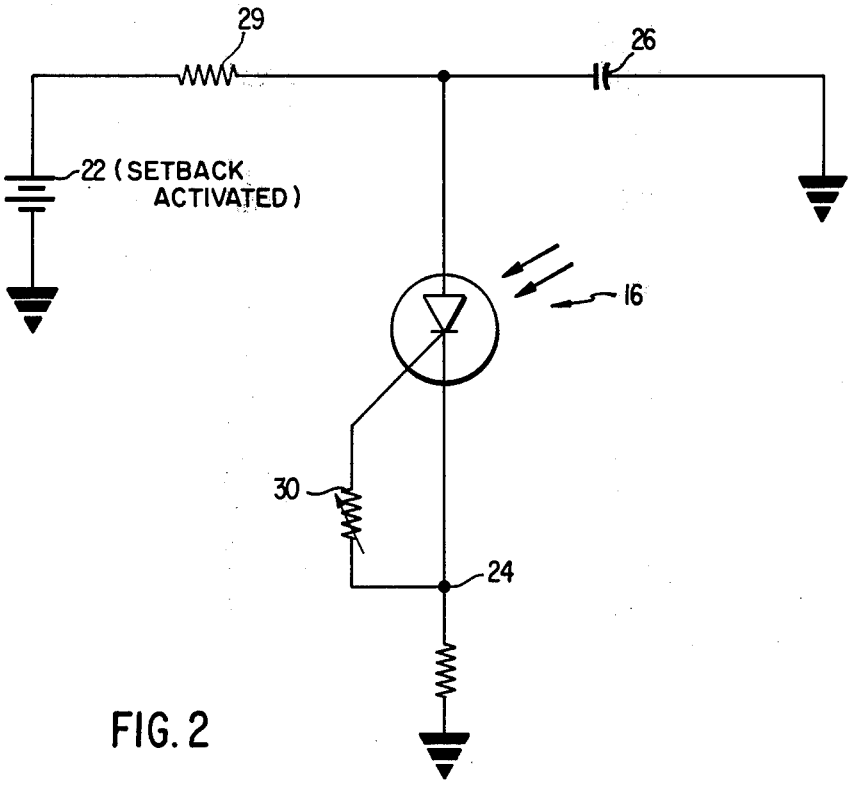
FIG. 2 is a schematic view of one of the fuze circuits in accordance with the present invention.

With reference to FIG. 2, there can be seen a potential electrical component arrangement which may be used in connection with the present invention. There is shown a power supply 22, such as a thermal battery or magnetic generator, which is activated by the setback forces when the warhead is launched, and an activator 26, such as a condensor, that is charged by an external power supply through resistor 29 before the warhead is launched. The photo-sensitive detector 16, such as a photo-silicon-controlled-rectifier, may be used to act as an on-off switch, which blocks current flow in the circuit until light of sufficient intensity strikes it. The photo-sensitive detector 16 preferably has a large impedance in the "off" position but when activated by light has a much lower impedance. Sensitivity control means 30, such as a gating-cathode resistance, may be utilized to control the light sensitivity of the device.

The detonator 24 fires when sufficient intense light strikes the photo-sensitive detector 16 and activates the circuit so as to allow current from the power source 22 to flow through the detonator 24 and thereby activate the explosive train.

Therefore, it can be seen that in accordance with a preferred embodiment of the present invention, light created by a triboluminescent material coated on the inside of a warhead ogive activates a photo-sensitive detector located behind the apex of the shaped charge liner, which allows current to flow through a detonator and activates the explosive in the warhead assembly. The two most essential concepts in the present invention are the utilization of light to communicate the warhead impact to the photo-sensitive detector and the use of the photo-sensitive detector to activate the detonator circuit when it receives the light.

The present invention will be still more further understood from the following:

EXAMPLES

A series of impact tests were carried out to determine the intensity of light output from triboluminescent materials under various impact conditions. Steel and aluminum projectiles were fired at targets on which the triboluminescent material was bonded to the face of the target opposite from the impact area. In some tests the light intensity was measured by a photo-multiplier tube and in others both a photo-multiplier and photo-SCR were used to detect the light. The light intensity at which a photo-SCR was triggered varied for each photo-SCR used. Each was calibrated prior to testing.

Tests were run using a warhead geometry and the ogive was impacted at various impact energies. It was determined whether or not the circuit was activated.

Data from these tests are shown below, for tests carried out with ZnS (Mn activated) triboluminescent material.

| Example | Projectile | Velocity m/sec | Light/Intensity $\mu W/cm^2$ | Target |
|---|---|---|---|---|
| Control 1* | Steel | 5 | 1.0 | Nose Cap |
| Control 2* | Steel | 4.1 | 0.54 | Nose Cap |
| Control 3* | Steel | 5.3 | 1.2 | Nose Cap |
| Control 4* | Steel | 3.7 | 0.3 | Nose Cap |
| Control 5* | Steel | 2.2 | 0.1 | Nose Cap |
| Control 6* | Steel | 5.0 | 0.8 | Nose Cap |
| Example 1 | Aluminum | 77 | 15.5 | Plexiglass |
| Example 2* | Steel | 51 | 12.5 | Plexiglass |
| Example 3 | Aluminum | 115 | 13.5 | Aluminum |
| Example 4* | Aluminum | 121 | 7 | Sandwich |
| Example 5 | Aluminum | 119 | 12.0 | Plexiglass |
| Example 6 | Aluminum | 123 | 13.0 | Plexiglass (taped) |
| Example 7 | Aluminum | 116 | 14.0 | Al (in holder) |
| Example 8 | Aluminum | 118 | 16 | Sandwich (in holder) |
| Example 9 | Aluminum | 123 | 27 | Sandwich (in holder) |

*Photo-SCR would not trigger at these light levels

Firings at the system in which a warhead was used with the triboluminescent material on the inside of the ogive and the photo-SCR at the apex of the copper cone gave the following results:

| Example | Projectile | Velocity m/sec | Circuit Trigger or Not |
|---|---|---|---|
| Example 10 | Steel | 105 | Yes |
| Example 11 | Steel | 89 | Yes |
| Example 12 | Steel | 75 | Yes |
| Example 13 | Steel | 100 | Yes |
| Example 14 | Steel | 95 | Yes |

The light output depends on the method used to bond the triboluminescent material to the material being impacted as well as the velocity of the impact and the energy of the shock or stress pulse that impinges on the triboluminescent material.

We wish it to be understood that we do not desire to be limited to the exact details of the construction shown and described, for obvious modifications can be made by a person skilled in the art.

What is claimed is:

1. In a warhead assembly having an explosive and a detonator for activating said explosive, a fuze comprising a triboluminescent material coated on the interior portion of said assembly, a photo-sensitive detector for detecting the light caused by said triboluminescent material upon impact of said warhead assembly, and means responsive to said photo-sensitive detector and communicating with said detonator so as to cause the detonator to activate and detonate the explosive.

2. The assembly of claim 1 including sensitivity control means for controlling the sensitivity of the device in response to the light from said triboluminescent material.

3. The assembly of claim 2 wherein said sensitivity control means is a varying gating-cathode resistance means.

4. The assembly of claim 1 wherein said warhead assembly contains an ogive and said triboluminescent material is coated on the entire inside surface of said ogive.

5. The assembly of claim 1 wherein said triboluminescent material is selected from the group consisting of $ZnF_2$:Mn, ZnS:Ag, ZnS:Mn, $CaP_2O_7$:$D_4$, a zirconium-tin-alloy and ZnCdS.

6. The assembly of claim 1 wherein said photo-sensitive detector comprises a photo-silicon-controlled-rectifier.

7. The assembly of claim 1 including a power supply activated by setback forces when the warhead is launched and a condensor that is charged by an external supply before the warhead is launched.

8. The assembly of claim 1 including means for amplifying the electrical signal from said photo-sensitive detector to said detonator.

9. The assembly of claim 1 wherein said triboluminescent material is a zirconium-tin-alloy.

10. The assembly of claim 1 wherein said triboluminescent material is ZnS:Ag.

11. The assembly of claim 1 wherein said triboluminescent material is ZnS:Mn.

12. The assembly of claim 1 wherein said triboluminescent material is $CaP_2O_7$:$D_4$.

13. The assembly of claim 1 wherein said triboluminescent material is ZnCdS.

14. The assembly of claim 1 wherein said triboluminescent material is $ZnF_2$:Mn.

* * * * *